US006534127B2

(12) United States Patent
Ohmoto et al.

(10) Patent No.: US 6,534,127 B2
(45) Date of Patent: Mar. 18, 2003

(54) COATING FILM FORMATION METHOD

(75) Inventors: Souji Ohmoto, Takarazuka (JP); Tohru Takeuchi, Yokohama (JP); Akira Kasari, Hiratsuka (JP); Hiroshi Shimizu, Yokohama (JP); Satoshi Ino, Hiratsuka (JP)

(73) Assignee: Kansai Paint Co., Ltd., Hyogo-ken (JP)

( * ) Notice: Subject to any disclaimer, the term of this patent is extended or adjusted under 35 U.S.C. 154(b) by 0 days.

(21) Appl. No.: 09/938,674

(22) Filed: Aug. 27, 2001

(65) Prior Publication Data

US 2002/0090461 A1 Jul. 11, 2002

(30) Foreign Application Priority Data

Oct. 5, 2000 (JP) ..... 2000-305713
Oct. 5, 2000 (JP) ..... 2000-305714

(51) Int. Cl.[7] ..... B05D 1/36

(52) U.S. Cl. ..... 427/407.1; 427/421; 427/427

(58) Field of Search ..... 427/407.1, 421, 427/427

*Primary Examiner*—Bernard Pianalto
(74) *Attorney, Agent, or Firm*—Wenderoth, Lind & Ponack, L.L.P.

(57) ABSTRACT

In a coating film formation method in which the thermosetting water-borne color paint (A) is coated on the surface of the substrate, then a thermosetting water-borne paint containing color pigment and/or glittering pigment (B) is coated on said coated surface, and, after predrying as necessary, a thermosetting clear paint (C) is coated and after that said 3-layer coating films of (A), (B) and (C) are simultaneously cured by heating, the solid content of the wet coat is controlled by an air jet step in which the air, whose temperature and/or humidity are controlled, is jetted from behind the paint nozzle in approximately the same direction as the atomized particles of said thermosetting water color paint (A) move to the surface of the substrate, when said paint is coated, around the spray pattern so that the air touches said pattern.

23 Claims, 3 Drawing Sheets

COATING FILM FORMATION METHOD

TECHNICAL FIELD TO WHICH THE INVENTION BELONGS

The present invention relates to a coating film formation method in which sogging etc. do not occur even in an atmosphere of low temperature and high humidity, the orientation of metallic pigment can be controlled particularly in case of using water-borne metallic paint and air-conditioning energy can be largely reduced in a 3-coat-1-bake coating film formation method using a water-borne paint.

PRIOR ART

Conventionally the coating of an intermediate paint or a topcoat paint was conducted generally in a booth whose inside was usually air-conditioned to suitably control the temperature and humidity. When the temperature and humidity in the booth are not controlled and largely fluctuate, the evaporation velocity of volatile components in the atomized paint particles in spray pattern area changes largely particularly at low temperature and high humidity and the wet film viscosity of the atomized paint particles largely fluctuates and consequently a normal coating film cannot be formed by occurrence of sogging of the wet coat or surface defect of the coating film etc., particularly in case of using a water-borne paint, compared with a solvent-type paint and therefore the air-conditioning control in the above-mentioned booth had to be strictly controlled. Moreover, in case of the coating with a water-borne metallic paint, the controlling tolerance was narrow, because the air-conditioning control influences the orientation of metallic pigment.

In the above-mentioned booth, the temperature and humidity are controlled while supplying and exhausting air, so the energy consumed for air-conditioning in the whole booth is considerable and usually the biggest in the steps in industrial coating line and the reduction of this energy has been an important problem.

The purpose of the present invention is to provide a coating film formation method in which sogging etc. do not occur even in an atmosphere of low temperature and high humidity, the orientation of metallic pigment can be controlled particularly in case of using water-borne metallic paint and air-conditioning energy can be largely reduced in a coating film formation method using a water-borne paint.

MEANS TO SOLVE THE PROBLEMS

The first embodiment of the present invention relates to a coating film formation method characterized by controlling the solid content of the wet coat by an air jet step in which the air, whose temperature and/or humidity are controlled, is jetted from behind the paint nozzle in approximately the same direction as the atomized particles of a thermosetting water-borne color paint (A) move to the surface of the substrate, when said paint is coated, around the spray pattern so that the air touches said pattern, in a coating film formation method in which the thermosetting water-borne color paint (A) is coated on the surface of the substrate, then a thermosetting water-borne paint containing color pigment and/or glittering pigment (B) is coated on said coated surface, and, after predrying as necessary, a thermosetting clear paint (C) is coated and after that said 3-layer coating films of (A), (B) and (C) are simultaneously cured by heating.

The second embodiment of the present invention relates to a coating film formation method characterized by controlling the solid content of the wet coat by conducting a high speed air blow step in which the substrate coated with a thermosetting water-borne color paint (A) is enveloped by air stream and then by an air jet step in which the air, whose temperature and/or humidity are controlled, is jetted from behind the paint nozzle in approximately the same direction as the atomized particles of a thermosetting water-borne paint containing color pigment and/or glittering pigment (B) move to the surface of the substrate, when said paint is coated, around the spray pattern so that the air touches said pattern in a coating film formation method in which the thermosetting water-borne color paint (A) is coated on the surface of the substrate, then the thermosetting water-borne paint containing color pigment and/or glittering pigment (B) is coated on said coated surface, and, after predrying as necessary, a thermosetting clear paint (C) is coated and after that said 3-layer coating films of (A), (B) and (C) are simultaneously cured by heating.

EMBODIMENT OF THE INVENTION

Figure 1A:
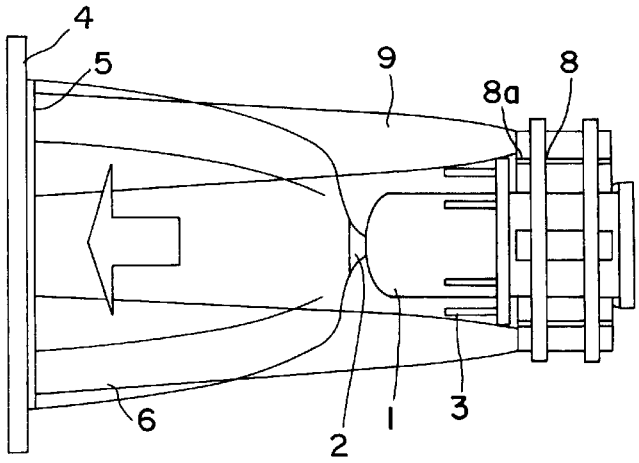
FIGS. 1*a* and 1*b* are schematic views of the method to control the solid content of the wet coat at a rotary atomizer (outer electrode) in the method of the present invention. (a) is a side view of the rotary atomizer in coating operation and (b) is a front view of the rotary atomizer seen from the bell cup side.

The thermosetting water-borne color paint (A) used in the present invention contains color pigment, and glittering pigment as necessary, water as main solvent and contains water-soluble or water-dispersible thermosetting resin.

As a water-soluble or water-dispersible thermosetting resin there can be mentioned, for example, acrylic resin, polyester resin, polyurethane resin and further self-crosslinking resins such as polyester resin etc. containing blocked isocyanate groups. Particularly acrylic resin or polyester resin having acid value of 20–100 mgKOH/g, hydroxyl value of 20–200 mgKOH/g is preferable.

As an acrylic resin mentioned above there can be mentioned copolymer, made by copolymerizing a mixture consisting of carboxyl group-containing unsaturated monomer, hydroxyl group-containing unsaturated monomer, and other unsaturated monomers, with number-average molecular weight of 3,000–100,000 preferably 5,000 to 50,000.

As a carboxyl group-containing unsaturated monomer there can be mentioned, for example, (meth)acrylic acid, crotonic acid, maleic acid, fumaric acid, itaconic acid and halfmonoalkyl-esterified compounds of dicarboxylic acids out of them and as a hydroxyl group-containing unsaturated monomer there can be mentioned, for example, hydroxyalkyl esters of acrylic acid or methacrylic acid such as hydroxyethyl (meth)acrylate, hydroxypropyl (meth) acrylate, hydroxybutyl (meth)acrylate etc. A kind or more than two kinds of them can be used.

As another unsaturated polymer there can be mentioned, for example, alkyl esters or cycloalkyl esters of a carbon number of 1–24 of acrylic acid or methacrylic acid such as methyl (meth)acrylate, ethyl (meth []acrylate, n-, i-propyl (meth)acrylate, n-, i-, t-butyl (meth)acrylate, 2-ethylhexyl (meth)acrylate, cyclohexyl (meth)acrylate, lauryl (meth)acrylate, isobornyl (meth)acrylate etc.; glycidyl (meth)acrylate, acrylonitrile, acrylamide, dimethylaminoethyl methacrylate, styrene, vinyltoluene, vinyl acetate, vinyl chloride etc. A kind or more than two kinds of them can be used.

An acrylic resin is a copolymer containing more than 20% by weight of alkyl ester or cycloalkyl ester of acrylic acid or methacrylic acid and a vinyl resin is a copolymer containing less than 20% by weight of them.

A polyester resin is an oil-free or oil-modified polyester resin prepared by esterification using polyhydric alcohol polybasic acid and further monbasic acid, oil component (including its fatty acid) etc. as necessary. Number-average molecular weight of the resin is suitable in the range of about 500–50000, preferably 3000–30000.

As a polyhydric alcohol there can be mentioned, for example, ethylene glycol diethylene glycol propylene glycol butanediol pentanediol hexanediol, 2,2-dimethylpropanedioL glycerol trimethylolpropane, pentaerythritol, Cardura E (made by Shell Chemicals Japan Ltd., trade name) etc. A kind or more than two kinds of them can be used. As a polybasic acid there can be mentioned, for example, phthalic acid, isophthalic acid, tetrahydrophthalic acid, hexahydrophthalic acid, maleic acid, succinic acid, adipic acid, sebacic acid, trimellitic acid, pyromellitic acid and their anhydrides etc. A kind or more than two kinds of them can be used. A monobasic acid there can be mentioned, for example, benzoic acid, t-butylbenzoic acid etc. and as oil component there can be mentioned, for example, castor oil, dehydrated castor oil, safflower oil, soybean oil, rinseed oil, tall oil, coconut oil and their fatty acids etc. A kind or more than two kinds of them can be used.

In a polyester resin a carboxyl group can be introduced, for example, by using a polybasic acid having more than 3 carboxyl groups in the molecule such as trimellitic acid, pyromellitic acid etc. together, or by half-esterification of dicarboxylic acid, and a hydroxyl group can be introduced easily by using a polyhydric alcohol having more than 3 hyroxyl groups in the molecule such as glycerol, trimethylolpropane etc. together.

As a hydroxyl group-containing resin mentioned above there can be applied a graft polymer made by grafting a polyester resin with an acrylic resin or vinyl resin and said graft polymer can be obtained by reacting (grafting) a polyester resin having polymerizable unsaturated groups with the above-mentioned unsaturated monomers.

Neutralization of carboxyl groups in the above-mentioned hydroxyl group-containing resin can be conducted by using a basic substance and preferably before mixing with a crosslinking agent etc.

A basic substance is preferably water-soluble and there can be mentioned, for example, ammonia, methylamine, ethylamine, propylamine, butylamine, dimethylamine, trimethylamine, triethylamine, ethylenediamine, morpholine, methylethanolamine, dimethylethanolamine, diethanolamine, triethanol amine, diisopropanolamine, 2-amino-2-methylpropanol etc. A kind or more than two kinds of them can be used.

As a crosslinking agent, for example, a blocked polyisocyanate, an amino resin etc. can be preferably used.

Application ratio of a neutralized product of the above-mentioned hydroxyl group-containing resin and a crosslinking agent is appropriate, as solid content weight, in the range of 50–90% by weight, preferably 60–80% by weight of the former and 50–10% by weight, preferably 40–20% by weight of the latter.

Coating film with said thermosetting water-borne color paint (A) may be made non-transparent solid tone or metallic tone by compounding color pigment or glittering pigment. As a color pigment there can be mentioned, for example, inorganic and organic color pigments such as titanium dioxide, carbon black, iron oxide red, phthalocyanine pigment, quinacridone pigment etc. and as a glittering pigment, for example, aluminium Rake aiming at improving hiding power, and for example, mica, mica-like iron oxide etc. aiming at designability. A kind or more than two kinds of them can be used. By compounding these pigments, hiding power of the coating film with the thermosetting water-borne color paint (A) is increased and an intermediate coating step may be omitted.

In the thermosetting water-borne color paint (A) there may be compounded, as necessary, additives for paint such as organic solvent, extender pigment, curing catalyst, levelling agent, pigment dispersing agent, viscosity controller, ultraviolet absorber, oxidation inhibitor etc.

As an organic solvent partly used in the thermosetting water-borne color paint (A) already known solvents can be used and there can be mentioned, for example, solvents of ester type, ketone type, ether type, alcohol type etc. A kind or more than two kinds of them can be used. Among them, it is preferable to use, particularly, a hydrophilic solvent which dissolves more than 50 parts by weight in 100 parts by weight of water at 20° C.

The thermosetting water-borne paint (B) used in the present invention contains color pigment and/or glittering pigment, water as main solvent, contains water-soluble or water-dispersible thermosetting resin and is compounded, as necessary, with extender pigment, levelling agent, viscosity controller, organic solvent etc.

As a water-soluble or water-dispersible thermosetting resin there can be mentioned acrylic resin, polyester resin, polyurethane resin etc. and particularly acrylic resin is preferable. Said water-soluble or water-dispersible thermosetting acrylic resin is a resin with acid value of 20–100 mgKOH/g, hydroxyl value of 20–200 mgKOH/g prepared by copolymerizing a mixture consisting of carboxyl group-containing unsaturated monomer, hydroxyl group-containing unsaturated monomer, and other unsaturated monomers. Such carboxyl group-containing unsaturated monomer, hydroxyl group-containing unsaturated monomer, and other unsaturated monomers can be suitably selected from what were mentioned in the description of the above-mentioned thermosetting water-borne color paint (A) and used. As a crosslinking agent used in combination with said acrylic resin there can be mentioned, for example, a blocked polyisocyanate, an amino resin etc.

As a color pigment there can be mentioned, for example, inorganic and organic color pigments such as titanium dioxide, carbon black, iron oxide red, phthalocyanine pigment, quinacridone pigment and as a glittering pigment there can be mentioned, for example, aluminium flake, mica, colored mica, mica-like iron oxide etc. A kind or more than two kinds of them can be used. The amount of said color pigment and glittering pigment to be used is appropriate in the range of 1–100 parts by weight to 100 parts by weight of the resin solid content.

The clear paint (C) used in the present invention is a thermosetting paint prepared by containing base resin, cross-liking agent, organic solvent etc. and by compounding, as necessary, color pigment, ultraviolet absorber, light stabilizer etc. It has such a transparency that the metallic effect of the lower layer coating film is visually recognized through the clear coating film.

As said base resin there can be mentioned, for example, acrylic resin, polyester resin, alkyd resin, fluororesin, urethane resin, silicon-containing resin etc. containing crosslinkable functional group, for example, hydroxyl group, carboxyl group, silanol group, epoxy group etc. Particularly acrylic resin containing crosslinkable functional group is preferable. As a crosslinking agent there can be mentioned melamine resin, urea resin, (blocked) polyisocyanate compound, epoxy compound, carboxyl group-containing compound, acid anhydride, alkoxysilane group-containing compound etc. which can react with such functional groups. The application ratio of said base resin and crosslinking agent is appropriate, as solid content, in the range of 50–90% by weight, preferably 65–80% by weight of the former and 50–10% by weight, preferably 45–20% by weight of the latter.

The coating film formation method of the present invention is to coat the above-mentioned thermosetting water-borne color paint (A) on the surface of a substrate, to coat the above-mentioned thermosetting water-borne paint (B) on said coated surface, to predry as necessary, then to coat the above-mentioned thermosetting clear paint (C) and to cure said 3-layer coating films (A), (B) and (C) simultaneously by heating.

As the surface of a substrate to be coated with the above-mentioned thermosetting water-borne color paint (A) there can be mentioned, for example, surface of a material such as metal, plastics etc. and further a coated surface such as a surface of an outer panel of a car body prepared by coating and curing an undercoat such as electrodeposition paint as necessary and intermediate coat.

Coating of the thermosetting water-borne color paint (A) is conducted by using rotary electrostatic coating, air spray (air spray nozzle), airless spray etc. Paint viscosity at the coating is preferably adjusted to Ford cup #4 about 10–60 seconds (20° C.) and the coating is conducted so that the coating film thickness would be about 2–30 $\mu$m as a cured coating film.

Then the thermosetting water-borne paint (B) is coated preferably while the wet film viscosity of said paint (A) remains more than 1 Pa.s, preferably in the range of 2–10 Pa.s (20° C.). Thus, the coating film of said paint (A) absorbs water of the paint (B) just after it is coated and consequently the wet film viscosity increased steeply under high humidity coating condition and a good orientation of glittering pigment can be obtained. Coating of said thermosetting water-boren paint (B) is conducted by using rotary electrostatic coating, air spray (air spray nozzle), airless spray etc. so that the coating film thickness would be about 2–30 $\mu$m as a cured coating film.

In the coating film formation method according to the first embodiment of the present invention the solid content of the wet coat is controlled to correspond to the above-mentioned range of the wet film viscosity by an air jet step in which the air, whose temperature and/or humidity are controlled, (hereinafter occasionally referred to as "controlling air") is jetted from behind the paint nozzle in approximniately the same direction as the atomized particles of said thermosetting water-borne color paint (A) move to the surface of the substrate, when said thermosetting water-borne color paint (A) is coated, around the spray pattern so that the air touches said pattern.

Moreover, the solid content of the wet coat may be controlled further by conducting a high speed air blow step in which the coated substrate is enveloped by air stream, as necessary, after the coating of said thermosetting water-borne color paint (A).

Further, the solid content of the wet coat may be controlled by conducting an air jet step, as necessary, at the coating of the above-mentioned thermosetting paint (B).

In the above-mentioned air jet step the controlling air is supplied from behind the paint nozzle in approximately the same direction as the moving direction of the atomized paint particles of the atomized paint particle pattern, formed by the paint being sprayed from a coating machine, to the surface of the substrate, around said atomized paint particle pattern so that the air touches said pattern. It is sprayed usually about parallel to the moving direction of the atomized paint particles and about vertically to the substrate.

The atomized paint particles sprayed from, for example, a rotary atomizer, form an atomized paint particle pattern by shaping air, into which the above-mentioned controlling air is drawn and touches the atomized paint particle pattern, and the controlling air may be taken into the atomized paint particle pattern to such an extent as not to disturb the pattern. The shaping air can control the temperature and humidity of the atmosphere inside the spray pattern by drawing the air, which has been formed in the surroundings and whose temperature and humidity have been controlled, can adjust the evaporation velocity of the volatile components (water, organic solvent etc.) from the atomized paint particles, and can control the solid content of the wet coat at the coating.

The temperature and humidity of the controlling air may be set up suitably according to the conditions of the air in the booth (temperature, humidity) and are not particularly restricted but are preferable in the range of usually 20–80° C., preferably 30–70° C. of the temperature at the coating surface and less than 30% RH, preferably 1–20% RH of the humidity. The controlling air can be formed, for example, by heating the open air, by heating and additional dehumidification, or optionally by dehumidification without heating. Moreover, the temperature and humidity of the shaping air may be previously controlled and thus the effect of the present invention can be improved more efficiently.

As mentioned above, it is possible to control the solid content of the wet coat of the atomized paint particles by the method of the present invention of locally blowing the controlling air without conventional air-conditioning of the whole booth.

Then the air jet step is explained based upon drawings.

Figure 1B:
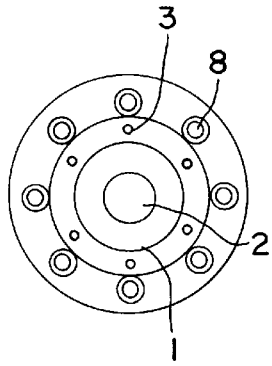
Figure 2A:
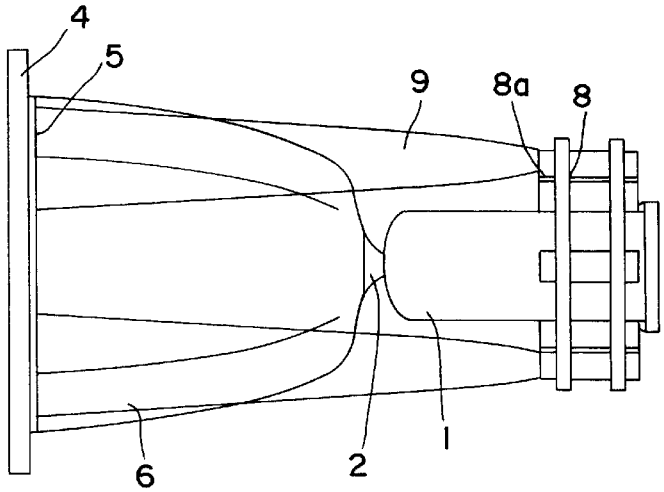
FIGS. 2*a* and 2*b* are schematic views of the method to control the solid content of the wet coat at a rotary atomizer (inner electrode) in the method of the present invention. (a) is a side view of the rotary atomizer in coating operation and (b) is a front view of the rotary atomizer seen from the bell cup side.
Figure 2B:
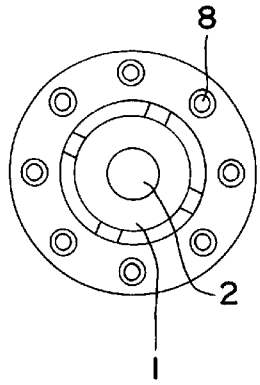
Figure 3A:
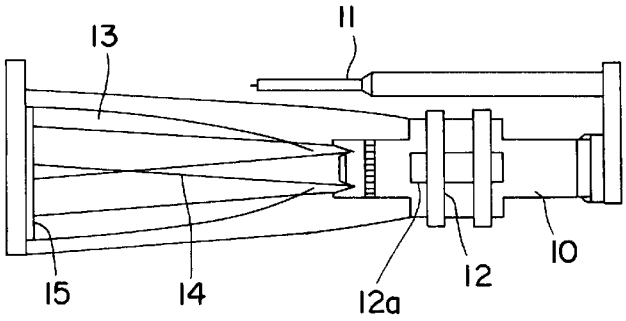
FIGS. 3*a* and *b* are schematic views of the method to control the solid content of the wet coat at an air spray nozzle in the method of the present invention. (a) is a side view of the air spray nozzle in coating operation and (b) is a front view seen from the controlling air jetter.
Figure 3B:
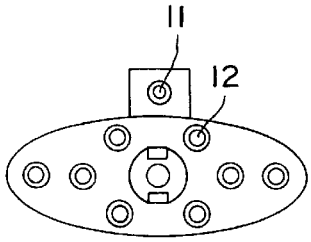

FIG. 1 is a schematic view explaining the air jet step at a rotary atomizer equipped with outer electrodes. (a) is a side view of the rotary atomizer in coating operation and (b) is a front view of the rotary atomizer seen from the bell cup side. FIG. 2 is a schematic view explaining the air jet step at a rotary atomizer (inner electrode type). (a) is a side view of the rotary atomizer in coating operation and (b) is a front view of the rotary atomizer seen from the bell cup side. FIG. 3 is a schematic view explaining the air jet step at an air spray nozzle. (a) is a side view of the air spray nozzle in coating operation and (b) is a front view seen from the controlling air jetter.

In FIG. 1 outer electrodes 3 and a plurality of air ducts 8, which blow out air, whose temperature and humidity are controlled, are equipped to the cylindrical body of the rotary atomizer 1. Each of the plurality of ducts 8 has an air jet nozzle 8*a*. Air jet nozzles 8*a* are equipped behind the paint nozzle against the substrate and said air ducts 8 are so arranged that a plurality of said air jet nozzles 8*a* form a circle. The air 9, whose temperature and humidity are controlled, is supplied from the plurality of air ducts 8 so that it envelops the atomized paint particle pattern [In FIG. 1(*a*) controlling air 9 jetted from 2 air ducts is described for the sake of explanation, but in fact the controlling air 9 is jetted from all the plurality of air ducts 8.].

As shown in FIG. 1(*b*) the outer electrodes 3 are arranged on a concentric circle with the circle formed by air jet nozzles 8*a* and the circumference of the bell cup. The diameter of the circle, on which outer electrodes 3 are arranged, is smaller than the diameter of the circle, on which air jet nozzles 8*a* of the air ducts 8 are arranged, but may be larger.

The air 9, whose temperature and humidity are controlled, can be formed, for example, by a conditioning air generator (not shown in Fig.). The formed controlling air 9 is supplied to air ducts 8 through a bellows hose (not shown in Fig.) and discharged from the air jet nozzles 8*a* of the air ducts 8, synchronized with a spray start signal, around the atomized paint particle pattern 6 of the atomized paint particles so as to envelop said pattern 6. Said pattern 6 is formed of the paint particles, formed by the bell cup 2, by the shaping air jetted from the circumference of the bell cup and the air, whose temperature and humidity are controlled, touches the atomized paint particle pattern 6 as an accompanying stream of the shaping air.

Therefore, the evaporation velocity of the volatile components (water, organic solvents etc.) of the atomized paint particles in the atomized paint particle pattern 6 is controlled by the atmosphere of the shaping air, accompanied by the controlling air 9 during said particles fly from the bell cup 2 to the substrate 4 and coat it and said particles can reach the surface of the substrate 4 with an appropriate solid content of the wet coat.

In FIG. 2, also, a plurality of air ducts 8, which blow out air, whose temperature and humidity are controlled, are equipped to the cylindrical body of the rotary atomizer 1. In the same manner as FIG. 1, except that no outer electrode part exists, the air 9, whose temperature and humidity are controlled, touches the atomized paint particle pattern 6 as an accompanying stream of the shaping air and controls the solid content of the wet coat. As a water-borne paint is coated by a rotary atomizer of inner electrode type, usually it is isolated at the paint supply side by a cartridge made of plastics or voltage block type etc. For the coating of inner panel part of a car body it is preferable to use a robot-bell, a small rotary atomizer, as the rotary atomizer 1.

In FIG. 3, too, outer electrodes 11 and a plurality of air ducts 12, which blow out air, whose temperature and humidity are controlled, are equipped to the cylindrical body 10 of an air spray nozzle. Each of these air ducts 12 has an air jet nozzle 12*a*. Air jet nozzles 12*a* are equipped behind the paint nozzle against the substrate and said air ducts 12 are so arranged that a plurality of said air jet nozzles 12*a* form an ellipse. The air 13, whose temperature and humidity are controlled, is supplied from the plurality of air ducts 12 so that it envelops the atomized paint particle pattern.

The air 13, whose temperature and humidity are controlled, can be formed, for example, by a conditioning air generator (not shown in Fig.). The formed controlling air 13 is supplied to air ducts 12 through a bellows hose (not shown in Fig.) and discharged from the air jet nozzles 12*a* of the air ducts 12, synchronized with a spray start signal, around the atomized paint particle pattern 14 of the atomized paint particles so as to envelop said pattern 14. Said pattern 14 is formed by the atomizing air/pattern air of the air spray nozzle and the air 13, whose temperature and humidity are controlled, touches the atomized paint particle pattern 14 as an accompanying stream of the atomizing air/pattern air. Therefore, the evaporation velocity of the volatile components (water, organic solvents etc.) of the atomized paint particles in the atomized paint particle pattern 14 is controlled by the atmosphere of the atomizing air/pattern air, accompanied by the controlling air during said particles fly to the substrate 15 and coat it and said particles can reach the surface of the substrate 15 with an appropriate solid content of the wet coat.

Then, the above-mentioned high speed air blow step is to conduct high speed air blow by enveloping a substrate coated with paint by air stream. Thus, the evaporation velocity of the volatile components (water, organic solvents etc.) from the coated surface is adjusted and the solid content of the wet coat after coating can be controlled. As the air stream the controlling air of the above-mentioned air jet step can be used and its temperature and humidity can be suitably set up in the same manner as the above-mentioned air jet step. Further, as said air stream, it is possible to use the air in the booth as it is and to accelerate the water evaporation by adjusting the manner of putting the air stream (horizontal vertical) or the velocity of the wind.

Then the high speed air blow step is explained based upon drawings.

Figure 4A:
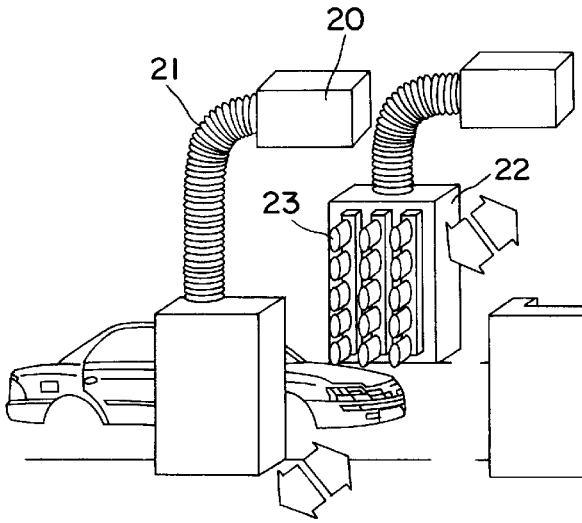
FIG. 4 is a schematic view describing the method to control the solid content of the wet coat in the method of the present invention. (a) is a view in which high speed air blow apparatus is equipped in the vertical direction to the line of the substrate delivery and (b) is a view in which high speed air blow apparatus is equipped in the horizontal direction to the line.
Figure 4B:
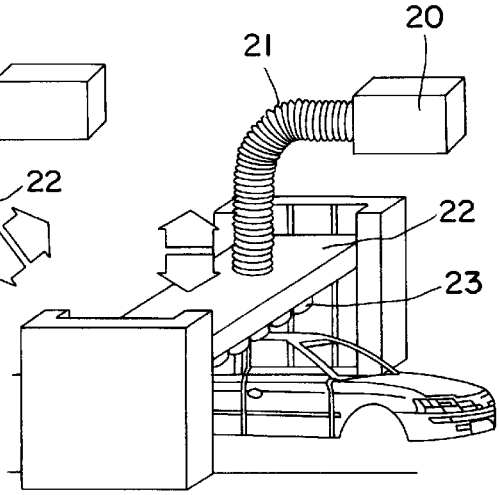

FIG. 4 is a schematic view explaining the high speed air blow step. (a) is a view in which a high speed air blow apparatus is equipped in a vertical direction to the substrate delivery line and (b) is a view in which a high speed air blow apparatus is equipped in a horizontal direction to the line.

In FIGS. 4(*a*) and (*b*) the high speed air blow apparatus is equipped with hot air generators 20 and hot air boxes 22 connected with a duct 21 and said hot air box 22 has a lot of outlets 23. Said outlet 23 is controlled according to the shape of the substrate if air blows out or not. In (a) the outlets 23 of hot air stream are placed for both sides of the substrate and in (b), on the other hand, the outlets 23 are placed over the top of the substrate. Each hot air box 22 are movable horizontally or vertically in order to adjust for the optimum distance of blowing hot air according to the position of the substrate.

Consequently the evaporation velocity of the volatile components (water, organic solvent etc.) at the coated surface of the coated substrate is controlled by the air stream to obtain the appropriate solid content of the wet coat and the setting and preheat steps can be largely reduced. Further, it is possible to eliminate these steps by improving the performance of such high speed air blow.

Moreover, in the coating film formation method of the present invention, the temperature and/or humidity and air amount of the controlling air used in the air jet step and the high speed air blow step can be automaticaly controlled to the optimum values based upon the previously programmed conditions according to the temperature and humidity of the booth.

Figure 5:
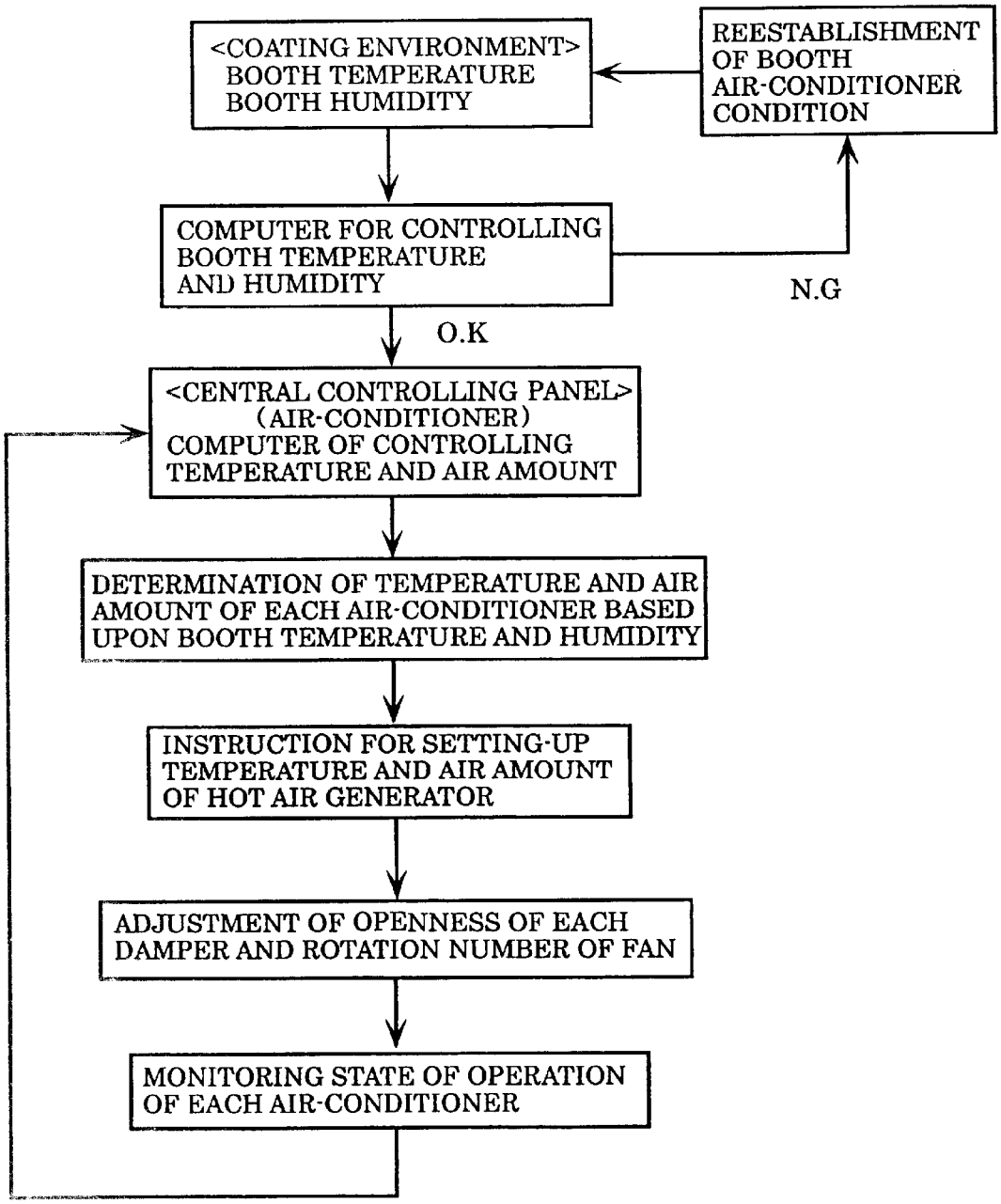
FIG. 5 is a flow diagram of the air-conditioning control system used in the method of the present invention.

Concretely it is described based upon FIG. 5. The temperature and humidity are sensed by sensors for temperature and humidity placed in the booth and the feed back signals are constantly sent and monitored to the controlling terminal for the temperature and humidity in the booth and the data of temperature and humidity are sent to the central controlling panel in real time. At said central controlling panel it is judged if the temperature and humidity in the booth are within the coatable range, if the temperature, humidity, air amount etc. of the controlling air used in the air jet step and the high speed air blow step are appropriate from the previously programmed conditions, calculated to the optimum values, then instruction for the temperature, humidity and air amount of the controlling air generator to be used in the air jet step and the high speed air blow step is sent, and the number of rotation of fan and the openness of control valve of each damper are automatically adjusted.

As described above, in the coating film formation method of the present invention, the predrying conducted after the coating of the above-mentioned thermosetting water-borne paint (B) is to heat at the predrying temperature of about 30–100° C. for about 2–5 minutes by hot air or infrared according to already known methods. As said predrying the above-mentioned high speed air blow step may be conducted, as necessary.

Coating with the clear paint (C) is conducted by using rotary electrostatic coating, air spray (air spray nozzle), airless spray etc. so that the coating film thickness be about 5–100 $\mu$m as cured coating film. After the coating with said clear paint (C), 3-layer coating films with paints (A)–(C) can be cured simultaneously by heating at 100–180° C. for 10–40 minutes.

In the coating film formation method according to the second embodiment of the present invention is to control the solid content of the wet coat to correspond to the above-mentioned wet film viscosity range by conducting a high speed air blow step in which the substrate coated with a thermosetting water-borne color paint (A) is enveloped by air stream, and then to control the solid content of the wet coat by the air jet step in which the air, whose temperature and/or humidity are controlled, is jetted from behind the paint nozzle in approximately the same direction as the atomized particles of the above-mentioned thermosetting water-borne paint (B) move to the surface of the substrate, when said paint is coated, around the spray pattern so that the air touches the said pattern.

The high speed air blow step in the coating film formation method according to the second embodiment of the present invention is conducted in the same manner as the high speed air blow step in the coating film formation method according to the first embodiment of the present invention as mentioned above. Namely, the high speed air blow step is conducted, for example, by a high speed air blow apparatus shown in FIG. 4.

The air jet step in the coating film formation method according to the second embodiment of the present invention is conducted in the same manner as the air jet step in the coating film formation method according to the first embodiment of the present invention as mentioned above.

Further, other steps in the coating film formation method according to the second embodiment of the present invention are conducted in the same manner as the steps used in the coating film formation method according to the first embodiment of the present invention as mentioned above.

EXAMPLES

Then, the present invention is described in more detail by examples. "Parts" and "%" show "parts by weight" and "% by weight" respectively, unless specified.

Preparation of Thermosetting Water-borne Color Paint (A)

140 parts of a neutralized acrylic resin solution with 50% solid content (Note 1) and 34 parts of "Cymel 370" (88% water-soluble melamine resin solution made by Mitsui Chemicals Inc.) were mixed and then 55 parts of Titanium White and 2 parts of carbon black were added thereto and dispersed. A thermosetting water-borne color paint (A) was obtained by adjusting the dispersion with deionized water to solid content of 35% and viscosity of 35 seconds (Ford cup #4, 20° C.).

(Note 1) 30 parts of methyl methacrylate, 23 parts of ethyl acrylate, 30 parts of butyl acrylate, 12 parts of hydroxyethyl methacrylate and 5 parts of acrylic acid were polymerized to make an acrylic resin solution (solid content 60%) with acid value 40, hydroxyl value of 52 and number-average molecular weight of about 10000. The solution was neutralized by adding dimetyla rinoethanol and then diluted with isopropyl alcohol to 50% solid content to make a neutralized acrylic resin solution.

Preparation of Thermosetting Water-borne Paint (B)

100 parts of a neutralized acrylic resin solution with 50% solid content (Note 1), 100 parts of a neutralized polyester resin solution with 50% solid content (Note 2), 500 parts of an acrylic emulsion with 20% solid content (Note 3) and 38 parts of "Cymel 370" were mixed and then 25 parts of "Aluminium Paste 891K" (made by Toyo Aluminium Co., Ltd.) were added and mixed. A thermosetting water-borne metallic paint (B) was obtained by adjusting the dispersion with deionized water to solid content of 25% and viscosity of 45 seconds (Ford cup #4, 20° C.).

(Note 2) 0.7 mole of neopentyl glycol, 0.3 mole of trimethylolpropane, 0.4 mole of phthalic anhydride and 0.5 mole of adipic acid were reacted for esterification and then 0.03 mole of trimellitic anhydride was added and further reacted. Then butyl cellosolve was added thereto to make a polyester resin solution (70% solid content) with acid value of 40 and number-average molecular weight of about 6000. The solution was neutralized by adding dimetylaminoethanol and then diluted with isopropyl alcohol to 50% solid content to make a neutralized polyester resin solution.

(Note 3) 140 parts of deionized water, 2.5 parts of 30% "Newcol 707SF" (surfactant made by Nippon Nyukazai Co., Ltd.) and 1 part of the monomer mixture A (55 parts of methyl methacrylate, 8 parts of styrene, 9 parts of butyl acrylate, 5 parts of hydroxyethyl acrylate, 2 parts of 1,6-hexanediol diacrylate and 1 part of methacrylic acid) were mixed and stirred under nitrogen gas stream, heated to 60° C. and 3 parts of 3% aqueous solution of ammonium persulfate were added. After warming up to 80° C., a monomer emulsion consisting of 79 parts of the monomer mixture A, 2.5 parts of "Newcol 707SF", 4 parts of 3% aqueous solution of ammonium persulfate and 2 parts of deionized water was added to the reaction vessel in 4 hours and matured for 1 hour. Then 20.5 parts of the monomer mixture B (5 parts of methyl methacrylate, 7 parts of butyl acrylate, 5 parts of 2-ethylhexyl acrylate, 3 parts of methacrylic acid and 0.5 parts of "Newcol 707SF") and 4 parts of 3% aqueous solution of ammonium persulfate were simultaneously added dropwise to the reaction vessel in 1.5 hours. The reaction mixture was then matured for 1 hour and diluted with 30 parts of deionized water.

An acrylic emulsion with 20% solid content was obtained by addition of deionized water to the filtrate and adjusting its pH to 7.5 with dimethylaminoethanol.

Preparation of clear paint (C)

A mixture consisting of 57 parts of an acrylic resin solution (Note 4), 50 parts of a non-aqueous acrylic resin dispersion (Note 5), 30 parts of "Cymel 303" (monomeric melamine resin made by Mitsui Chemicals Inc.), 4 parts of 25% dodecylbenzenesulfonic acid solution and 0.5 parts of "BYK-300" (levelling agent made by BYK-CHEMIE Co.) was adjusted to viscosity of 30 seconds (Ford cup #4, 20° C.) with "Swasol #1000" (aromatic hydrocarbon type solvent made by Cosmo Oil Co., Ltd.) to obtain a clear paint with 55% solid content.

(Note 4) 40 parts of "Swasol #1000" were placed in a reaction vessel and heated to 120° C. A monomer mixture consisting of 30 parts of styrene, 35 parts of butyl acrylate, 10 parts of 2-ethylhexyl acrylate, 25 parts of hydroxyethyl acrylate and 4 parts of α,α'-azobisisobutyronitrile was added thereto for 3 hours and polymerized to obtain an acrylic resin solution (70% solid content) with hydroxyl value of 120 and number-average molecular weight of 6000.

(Note 5) 58 parts of "U-Van 28–60" (60% melamine resin solution made by Mitsui Chemicals Inc.), 30 parts of n-heptane and 0.15 parts of benzoyl peroxide were placed in a reaction vessel and heated to 95° C. Then a mixture consisting of 15 parts of styrene, 9 parts of acrylonitrile, 13 parts of methyl methacrylate, 15 parts of methyl acrylate, 1.8 parts of butyl acrylate, 10 parts of hydroxyethyl methacrylate, 1.2 parts of acrylic acid, 0.5 parts of benzoyl peroxide, 5 parts of n-butanoL 30 parts of "Shellsol 140" (made by Shell Chemicals Japan Ltd.) and 9 parts of n-heptane was added thereto dropwise in 3 hours. After maturation for 1 hour, 0.65 parts of t-butyl peroctoate and 3.5 parts of "Shellsol 140" were added thereto dropwise in 1 huor. After stirring at 95° C. for 2 hours the solvent was removed under reduced pressure to obtain a non-aqueous acrylic resin dispersion with solid content of 60% of and varnish viscosity A (Gardner-Holdt bubble viscosity).

Examples 1–9 and Comparative Examples 1–5

A steel plate, which had been degreased and treated with zinc phosphate, was coated by electrodeposition with "Elecron #9400" (cationic electrodeposition paint made by Kansai Paint Co., Ltd. trade name) by a usual method to 20 μm of dry film thickness and cured by heating at 175° C. for 30 minutes to obtain the substrate 1. Said substrate 1 was further coated with an intermediate surfacer for car by air spray coating to 30 μm of dry film thickness and cured by heating at 140° C. for 30 minutes to obtain the substrate 2.

The above-mentoined substrates 1 and 2 were coated with the paint (A) prepared as mentioned above under the conditions shown in Table 1, kept for 3 minutes, coated with the paint (B) under the conditions shown in Table 1, kept for 3 minutes, preheated at 80° C. for 10 minutes as necessary, coated with the paint (C) under the conditions shown in Table 1, kept for 7 minutes, and then cured by heating at 140° C. for 30 minutes to obtain each coated plate.

Coating was conducted at the temperature of the whole booth of the paints (A) and (B) of 25° C., varying the humidity to 70% RH and 90% RH, selecting if the mode of controlling the solid content of the wet coat by the air jet step shown in FIG. 1 be applied or not, selecting if the mode of controlling the solid content of the wet coat by the high speed air blow step shown in FIG. 3 be applied or not, and selecting if the preheat step before coating with the paint (C) be applied or not, in a rotary atomizing coating as shown in Table 2 in each example and reference example. In the air jet step shown in FIG. 1 the air 9, whose temperature and humidity were controlled, was jetted in setting up the temperature (at the surface of substrate) to 50–60° C. (10% RH) and the supplying amount to 1 $m^3$/minute. In the high speed air blow step shown in FIG. 3(*a*) the high speed air blow was conducted for 2 minutes in setting up the temperature of the hot air at the surface of substrate to 60° C., the wind speed to 20 m/sec and the amount of air to 1 $m^3$/minute.

The solid content of the wet coat after 1 minute from the coating with the paint (A) and before coating with the paint (C) in each example and reference example was measured and the metallic effect, IV value and glossy appearance of the obtained coated plate were evaluated. Results are shown in Table 2 together. (*1) Metallic effect: Metallic effect (glittering impression, whiteness etc.) was visually evaluated. (◎: excellent in metallic effect, ○: metaric effect is a little inferior, Δ: no glittering impression and inferior in whiteness, x: no glittering impression and whiteness at all). (*2) IV value: Measured by using "Alcope" (made by Kansai Paint Co., Ltd.). The bigger the value is, the better the orientation of aluminium is meant. (*3) Glossy appearance: Glossy appearance was visually evaluated (◎: excellent in glossy appearance, ○: Glossy appearance is a little inferior, Δ: inferior in glossy appearance, x: no glossy appearance).

TABLE 1

| | (A) | (B) | (C) |
|---|---|---|---|
| Paint | M-Bell Outer | | M-Bell Inner |
| Coating machine | electrode 70 ∅ | | electrode 70 ∅ |
| Coating condition | | | |
| Number of coating machine | 1 | 1 | 1 |
| Number of stages | 2 pass | 2 pass | 2 pass |
| number of rotation (rpm) | 30000 | 35000 | 30000 |
| Shaping air pressure (kg/cm$^2$) | 1.0 | 1.0 | 1.0 |
| Applied voltage (kV) | −60 | −60 | −60 |
| Paint delivery (cc/mm) | 200 | 120 | 190 |

TABLE 2

| | 1 | 2 | 3 | 4 | 5 | 6 | 7 | 8 | 9 |
|---|---|---|---|---|---|---|---|---|---|
| Coating | | | | | | | | | |
| Substrate | ② | ① | ① | ① | ① | ① | ① | ① | ① |
| Booth temperature (° C.) | 25 | 25 | 25 | 25 | 25 | 25 | 25 | 25 | 25 |
| Booth humidity (% RH) | 70 | 70 | 90 | 90 | 90 | 90 | 90 | 70 | 70 |
| Paint (A) Air jet step | applied | applied | applied | applied | applied | applied | applied | applied | applied |
| High speed air blow step | not applied | not applied | not applied | not applied | applied | applied | not applied | applied | applied |
| Paint (B) Air jet step | not applied | not applied | not applied | not applied | applied | applied | applied | not applied | not applied |
| High speed air blow step | not applied | not applied | not applied | applied | not applied | applied | applied | applied | not applied |
| Preheat | applied | applied | applied | not applied | applied | not applied | not applied | not applied | applied |
| Evaluation | | | | | | | | | |
| Metallic effect | ○ | ○ | ○ | ○ | ○ | ○ | ○ | ○ | ○ |
| IV value | 168 | 168 | 162 | 160 | 180 | 180 | 176 | 171 | 170 |
| Glossy appearance | ⊙ | ○ | ○ | ○ | ○ | ○ | ○ | ○ | ○ |
| Solid content of the wet coat at 1 minute after coating of paint (A) (%) | 53 | 53 | 50 | 50 | 50 | 50 | 50 | 50 | 50 |
| Solid content of the wet coat after high speed air blow step of paint (A) (%) | | | | | 68 | 68 | | 68 | 68 |
| Solid content of the wet coat before coating with paint (C) (%) | 94 | 94 | 92 | 90 | 94 | 94 | 92 | 91 | 90 |

| | Comparative Example | | | | |
|---|---|---|---|---|---|
| | 1 | 2 | 3 | 4 | 5 |
| Coating | | | | | |
| Substrate | ② | ① | ① | ① | ① |
| Booth temperature (° C.) | 25 | 25 | 25 | 25 | 25 |
| Booth humidity (% RH) | 70 | 70 | 90 | 90 | 90 |
| Paint (A) Air jet step | not applied | not applied | not applied | not applied | not applied |
| High speed air blow step | not applied | not applied | not applied | applied | applied |
| Paint (B) Air jet step | not applied | not applied | not applied | not applied | not applied |
| High speed air blow step | not applied | not applied | not applied | not applied | applied |
| Preheat | applied | applied | applied | applied | not applied |
| Evaluation | | | | | |
| Metallic effect | X | X | X | Δ | Δ |
| IV value | 120 | 120 | 90 | 140 | 140 |
| Glossy appearance | X | X | X | Δ | Δ |
| Solid content of the wet coat at 1 minute after coating of paint (A) (%) | 40 | 40 | 37 | | |
| Solid content of the wet coat after high speed air blow step of paint (A) (%) | | | | 57 | 57 |
| Solid content of the wet coat before coating with paint (C) (%) | 92 | 92 | 90 | 90 | 87 |

From the above-mentioned results it is possible to control the solid content of the wet coat at 1 minute after coating of the paint (A) to more than 50% by using the air jet step to control the solid content of the wet coat and to further increase the solid content of the wet coat before coating with the paint (B) by using the high speed air blow step together. Thus, the coating film of the paint (A) absorbs water just after the coating with the paint (B) when the paint (B) is coated and therefore the wet film viscosity steeply increases even under the coating condition at high humidity of 90% RH and good orientation of glittering pigment is obtained.

Further, at the coating with the paint (B), too, it is possible to control the solid content of the wet coat of the paint (B) by using the air jet step, to increase the solid content of the wet coat before coating with the paint (C) without preheat more than 80% by using the high speed air blow step, to obtain the same finishing property as in case of bringing the whole booth to lower humidity, even if the booth has a highly humid atmosphere, and to reduce the control of temperature and humidity of the whole booth. Moreover, the same finishing property is obtained with a substrate without intermediate coating step and thus it is possible to eliminate the intermediate coating step.

Examples 10–14 and Comparative Examples 6–10

The substrates 1 and 2, prepared in the same manner as in the above-mentioned Examples 1–9 and Comparative Examples 1–5 were coated with the paint (A) prepared as mentioned above under the conditions shown in Table 3, kept for 3 minutes, coated with the paint (B) under the conditions shown in Table 3, kept for 3 minutes, preheated at 80° C. for 10 minutes as necessary, coated with the paint (C) under the conditions shown in Table 3, kept for 7 minutes, and cured by heating at 140° C. for 30 minutes to obtain each coated plate.

Coating was conducted at the temperature of the whole booth of the paints (A) and (B) of 25° C., varying the humidity to 70% RH and 90% RH, selecting if the mode of controlling the solid content of the wet coat by the high speed air blow step shown in FIG. 4(*b*) be applied or not, selecting if the mode of controlling the solid content of the wet coat by the air jet step shown in FIG. 1 be applied or not, and selecting if the preheat step before coating with the paint (C) in a rotary atomizing coating as shown in Table 4 in each example and reference example. In the high speed air blow step shown in FIG. 4(*a*) the high speed air blow was conducted for 2 minutes in setting up the temperature of the hot air at the surface of substrate to 60° C., the wind speed to 20 m/sec and the amount of air to 1 $m^3$/minute. In the air jet step shown in FIG. 1 the air 9, whose temperature and humidity were controlled, was jetted in setting up the temperature (at the surface of substrate) to 50–60° C. (10% RH) and the supplying amount to 1 $m^{3/minute}$.

TABLE 3

| | (A) | (B) | (C) |
|---|---|---|---|
| Paint | M-Bell Outer | | M-Bell Inner |
| Coating machine | electrode 70 ∅ | | electrode 70 ∅ |
| Coating condition | | | |
| Number of coating machine | 1 | 1 | 1 |
| Number of stages | 2 pass | 2 pass | 2 pass |
| number of rotation (rpm) | 30000 | 35000 | 30000 |
| Shaping air pressure (kg/$cm^2$) | 1.0 | 1.0 | 1.0 |
| Applied voltage (kV) | −60 | −60 | −60 |
| Paint delivery (cc/mm) | 200 | 120 | 190 |

TABLE 4

| | | Example | | | | | Comparative Example | | | | |
|---|---|---|---|---|---|---|---|---|---|---|---|
| | | 10 | 11 | 12 | 13 | 14 | 6 | 7 | 8 | 9 | 10 |
| Coating | | | | | | | | | | | |
| Substrate | | ② | ① | ① | ① | ① | ② | ① | ① | ① | ① |
| Booth temperature (° C.) | | 25 | 25 | 25 | 25 | 25 | 25 | 25 | 25 | 25 | 25 |
| Booth humidity (% RH) | | 70 | 70 | 90 | 70 | 90 | 70 | 70 | 90 | 90 | 90 |
| Paint (A) | High speed air blow step | applied | applied | applied | applied | applied | not applied | not applied | not applied | applied | applied |
| Paint (B) | Air jet step | applied | applied | applied | applied | applied | not applied | not applied | not applied | not applied | not applied |
| | High speed air blow step | not applied | not applied | not applied | applied | applied | not applied | not applied | not applied | not applied | applied |
| Preheat | | applied | applied | applied | not applied | not applied | applied | applied | applied | applied | not applied |
| Evaluation | | | | | | | | | | | |
| Metallic effect | | ○ | ○ | ○ | ○ | ○ | X | X | X | Δ | Δ |
| IV value | | 171 | 171 | 163 | 171 | 163 | 120 | 120 | 90 | 140 | 140 |
| Glossy appearance | | ◎ | ○ | ○ | ○ | ○ | X | X | X | Δ | Δ |
| Solid content of the wet coat at 1 minute after coating of paint (A) (%) | | | | | | | 40 | 40 | 37 | | |
| Solid content of the wet coat after high speed air blow step of paint (A) (%) | | 61 | 61 | 57 | 61 | 57 | | | | 57 | 57 |
| Solid content of the wet coat before coating with paint (C) (%) | | 93 | 93 | 91 | 87 | 83 | 92 | 92 | 90 | 90 | 87 |

The solid content of the wet coat after 1 minute from the coating with the paint (A) and before coating with the paint (C) in each Example 10–14 and Reference example 6–10 was measured and the metallic effect, IV value and glossy appearance of the obtained coated plate were evaluated. Results are shown in Table 4 together. (*1) Metallic effect: Metallic effect (glittering impression, whiteness etc.) was visually evaluated. (◎: excellent in metallic effect, ○: metallic effect is a little inferior, Δ: no glittering impression and inferior in whiteness, X: no glittering impression and whiteness at all). (*2) IV value: Measured by using "Alcope" (made by Kansai Paint Co., Ltd.). The bigger the value is, the better the orientation of aluminium is meant. (*3) Glossy appearance: Glossy appearance was visually evaluated (◎: excellent in glossy appearance, ○: Glossy appearance is a little inferior, Δ: inferior in glossy appearance, X: no glossy appearance).

From the above-mentioned results it is possible to increase the solid content of the wet coat of the paint (A) to more than 50% by using the high speed air blow step to control the solid content of the wet coat. Thus, the coating film of the paint (A) absorbs water just after the coating with the paint (B) when the paint (B) is coated and therefore the wet film viscosity steeply increases even under the coating condition at high humidity of 90% RH and good orientation of glittering pigment is obtained. Further, by using the air jet step at the coating with the paint (B) the solid content of the wet coat of the paint (B) can be controlled and the orientation of glittering pigment is further improved. Moreover, it is possible to increase the solid content of the wet coat before coating with the paint (C) without preheat to more than 80% by using the high speed air blow step, to obtain the same finishing property as in case of bringing the whole booth to lower humidity even if the booth has a highly humid atmosphere, and to reduce the control of temperature and humidity of the whole booth. Moreover, the same finishing property is obtained with a substrate without intermediate coating step and thus it is possible to eliminate the intermediate coating step.

According to the method of the present invention, in a coating film formation method using a water-borne paint it is possible to control the orientation of metallic pigment, particularly in water-borne metallic paint, without occurence of sogging etc. even in an atmosphere of low temperature and high humidity by 3-coat-1-bake finishing to coat a thermosetting water-borne paint on a coated surface with a specified thermosetting water-borne color paint and by further combining steps to control the solid content of the wet coat, and to realize a big reduction of air-conditioning energy.

What is claimed is:

1. A coating film formation method to control a solid content of a wet coat, which comprises jetting air, whose temperature and/or humidity are controlled, from behind a paint nozzle in approximately the same direction as atomized particles of a thermosetting water-borne color paint (A) move to the surface of a substrate, when said paint is coated, round a spray pattern so that the air touches said pattern in a coating film formation method in which the thermosetting water-borne color paint (A) is coated on the surface of the substrate, then a thermosetting water-borne paint containing color pigment and/or glittering pigment (B) is coated on said coated surface, and, after predrying as necessary, a thermosetting clear paint (C) is coated and the resultant 3-layer coating films of (A), (B) and (C) are simultaneously cured by heating.

2. The coating film formation method set forth in claim 1 in which a high speed air blow step is conducted by enveloping a coated substrate with an air stream after the coating with the paint (A).

3. The coating film formation method set forth in claim 2 in which the solid content of the wet coat is controlled by conducting the air jet step at the time of coating with the paint (B).

4. The coating film formation method set forth in claim 2 in which the temperature of predrying after the coating with the paint (B) is 30–100° C.

5. The coating film formation method set forth in claim 2 in which the predrying after the coating with the paint (B) is the high speed air blow step.

6. The coating film formation method set forth in claim 2 in which the temperature and/or humidity and air amount of the air used in the air jet step and/or high speed air blow step are automatically controlled to optimum values based upon previously programmed conditions according to the temperature and humidity of a booth.

7. The coating film formation method set forth in claim 1 in which the solid content of the wet coat is controlled by conducting the air jet step at the time of coating with the paint (B).

8. The coating film formation method set forth in claim 7 in which the temperature of predrying after the coating with the paint (B) is 30–100° C.

9. The coating film formation method set forth in claim 7 in which the predrying after the coating with the paint (B) is a high speed air blow step.

10. The coating film formation method set forth in claim 7 in which the temperature and/or humidity and air amount of the air used in the air jet step and/or thigh speed air blow step are automatically controlled to optimum values based upon previously programmed conditions according to the temperature and humidity of a booth.

11. The coating film formation method set forth in claim 1 in which the temperature of predrying after the coating with the paint (B) is 30–100° C.

12. The coating film formation method set forth in claim 11 in which the predrying after the coating with the paint (B) is a high speed air blow step.

13. The coating film formation method set forth in claim 11 in which the temperature and/or humidity and air amount of the air used in the air jet step and/or a high speed air blow step are automatically controlled to optimum values based upon previously programmed conditions according to the temperature and humidity of a booth.

14. The coating film formation method set forth in claim 1 in which the predrying after the coating with the paint (B) is a high speed air blow step.

15. The coating film formation method set forth in claim 14 in which the temperature and/or humidity and air amount of the air used in the air jet step and/or high speed air blow step are automatically controlled to optimum values based upon previously programmed conditions according to the temperature and humidity of a booth.

16. The coating film formation method set forth in claim 1 in which the temperature and/or humidity and air amount of the air used in the air jet step and/or a high speed air blow step are automatically controlled to optimum values based upon previously programmed conditions according to the temperature and humidity of a booth.

17. A coating film formation method to control a solid content of a wet coat, which comprises conducting a high speed air blow step in which a substrate coated with a thermosetting water-borne color paint (A) is enveloped by an air stream and then jetting air, whose temperature and/or humidity are controlled, from behind a paint nozzle in approximately the same direction as atomized particles of a thermosetting water-borne paint containing color pigment and/or glittering pigment (B) move to the surface of the substrate, when said paint is coated, around a spray pattern so that the air touches said pattern in a coating film formation method in which the thermosetting water-borne color paint (A) is coated on the surface of the substrate, then the thermosetting water-borne paint containing color pigment and/or glittering pigment (B) is coated on said coated surface, and, after predrying as necessary, a thermosetting clear paint (C) is coated and the resultant 3-layer coating films of (A), (B) and (C) are simultaneously cured by heating.

18. The coating film formation method set forth in claim 17 in which the temperature of predrying after the coating with the paint (B) is 30–100° C.

19. The coating film formation method set forth in claim 18 in which the predrying after the coating with the paint (B) is a high speed air blow step.

20. The coating film formation method set forth in claim 18 in which the temperature and/or humidity and air amount of the air used in the air jet step and/or high speed air blow step are automatically controlled to optimum values based upon previously programmed conditions according to the temperature and humidity of a booth.

21. The coating film formation method set forth in claim 17 in which the predrying after the coating with a paint (B) is a high speed air blow step.

22. The coating film formation method set forth in claim 21 in which the temperature and/or humidity and air amount of the air used in the air jet step and/or high speed air blow step are automatically controlled to optimum values based upon previously programmed conditions according to the temperature and humidity of a booth.

23. The coating film formation method set forth in claim 17 in which the temperature and/or humidity and air amount of the air used in the air jet step and/or high speed air blow step are automatically controlled to optimum values based upon previously programmed conditions according to the temperature and humidity of a booth.

* * * * *